US009717636B1

(12) United States Patent
Blanco

(10) Patent No.: US 9,717,636 B1
(45) Date of Patent: Aug. 1, 2017

(54) BILATERALLY SHIFTING WHEELCHAIR SEAT

(71) Applicant: Adolfo Blanco, Miami, FL (US)

(72) Inventor: Adolfo Blanco, Miami, FL (US)

(73) Assignee: Adolfo Blanco, Miami, FL (US)

( * ) Notice: Subject to any disclaimer, the term of this patent is extended or adjusted under 35 U.S.C. 154(b) by 0 days.

(21) Appl. No.: 14/870,231

(22) Filed: Sep. 30, 2015

(51) Int. Cl.
*A61G 5/10* (2006.01)
*A61G 5/04* (2013.01)

(52) U.S. Cl.
CPC ..... *A61G 5/1056* (2013.01); *A61G 5/04* (2013.01)

(58) Field of Classification Search
CPC .. A61G 5/1056; A61G 5/04; A61G 2005/124; A61G 2005/1081
USPC ..... 297/314
See application file for complete search history.

(56) References Cited

U.S. PATENT DOCUMENTS 5,588,704 A * 12/1996 Harza ..... A47C 3/0255 297/314
6,325,167 B1 * 12/2001 Jiang ..... A61G 5/04 180/9.32
8,439,442 B2 * 5/2013 Highlander ..... A47C 7/14 297/302.7
8,684,398 B1 * 4/2014 Nyitray ..... A61G 5/10 280/250.1
2005/0279540 A1 12/2005 Wisner
2012/0038128 A1 * 2/2012 Nimura ..... A61G 5/1005 280/250.1

* cited by examiner

*Primary Examiner* — David R Dunn
*Assistant Examiner* — Tania Abraham
(74) *Attorney, Agent, or Firm* — Christian Sanchelima; Jesus Sanchelima

(57) ABSTRACT

A universal bilaterally shifting wheelchair seat assembly that uses a battery powered control unit assembly including an electrical motor to bilaterally displace a wheelchair seat a predetermined distance to help prevent pressure ulcers. The control unit assembly is connected to an actuating disk using a shaft that travels through a channel in the wheelchair seat. The actuating disk includes an actuating rod mounted to the bottom of the seat that bilaterally moves the seat upon the actuating disk's rotational movement. The wheelchair seat can include an electrical regulator that a user can adjust to modulate the frequency and speed of the seat's displacement.

6 Claims, 4 Drawing Sheets

BILATERALLY SHIFTING WHEELCHAIR SEAT

BACKGROUND OF THE INVENTION

1. Field of the Invention

The present invention relates to a wheelchair seat and, more particularly, to a wheelchair seat that is displaced from its original position sufficiently to help prevent complications associated with pressure ulcers in wheelchair bound patients.

2. Description of the Related Art

Several designs for adjustable wheelchair seats have been designed in the past. None of them, however, include an actuating assembly that displaces the seat laterally so that a user does not continually spend great amounts of time in a fixed, single position.

Applicant believes that a related reference corresponds to U.S. patent application No. US20050279540 issued to Donald Wisner. However, it differs from the present invention because the Wisner reference moves the seat forward and back as well as tilting the seat. The present invention utilizes many less components and is focused on moving the seat in a bilateral motion a predetermined distance sufficient to prevent pressure ulcers.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a moving seat assembly that shifts laterally in a bilateral motion a sufficient distance displacing a user's weight on the seat thereby helping to prevent pressure ulcers.

It is another object of this invention to provide a moving seat assembly that cooperates with a control unit to bilaterally shift the seat at a preselected frequency that can be controlled by a user.

It is still another object of the present invention to provide a moving seat assembly actuated by a motor that can be powered by a battery to ensure independent wheelchair mobility.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
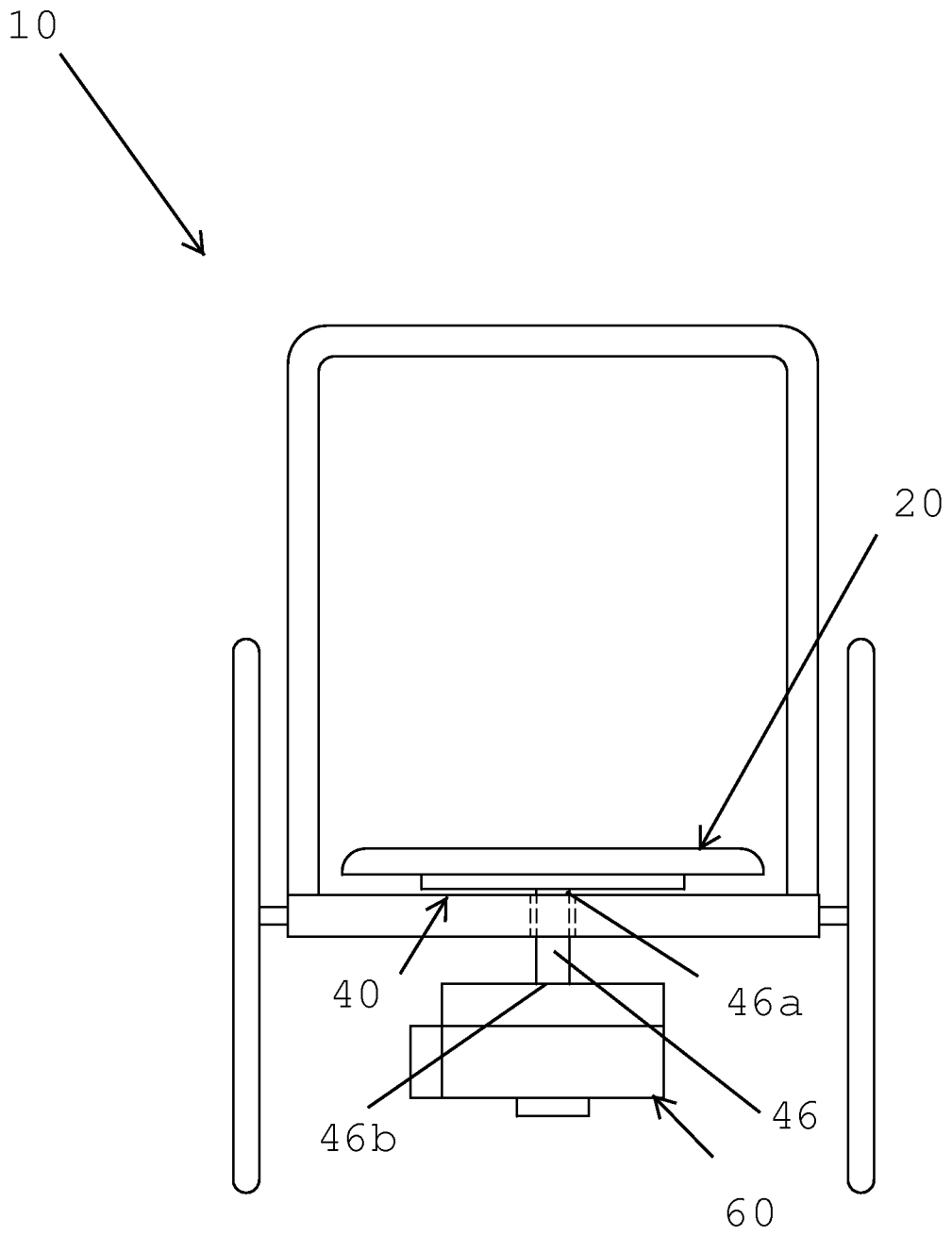
FIG. 1 represents a front elevational view of the present invention having seat assembly 20 mounted to a wheelchair using actuating assembly 40.

Referring now to the drawings, where the present invention is generally referred to with numeral 10, it can be observed that it basically includes seat assembly 20, actuating assembly 40, and control unit assembly 60.

As shown in FIG. 1, seat assembly 20 includes seat member 22 that is positioned on the seat 12 of a wheelchair 14. As shown on FIGS. 2-2C, seat member 22 is mounted at its bottom surface to first distal end 41 of actuating rod 42 at a predetermined location on the bottom surface to cooperate for effective bilateral movement.

Figure 2:
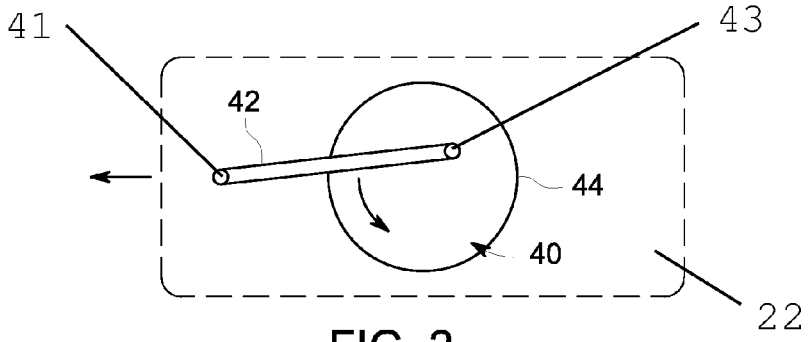
FIG. 2 is a see-through view of seat assembly 20 to show actuating member 40 in its starting position.
Figure 2A:
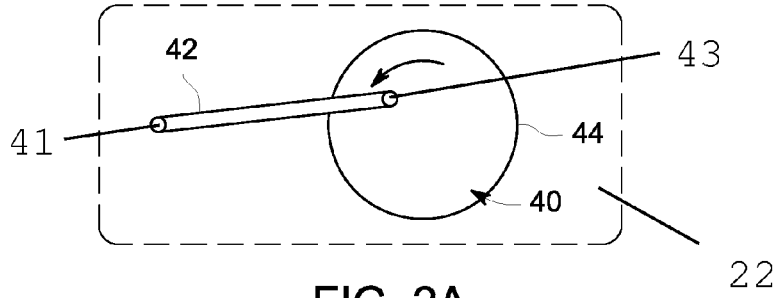
FIG. 2A is a see-through view of seat assembly 20 to show actuating member 40 in its displaced position thereby laterally shifting seat assembly 20 to the left a predetermined distance.
Figure 2B:
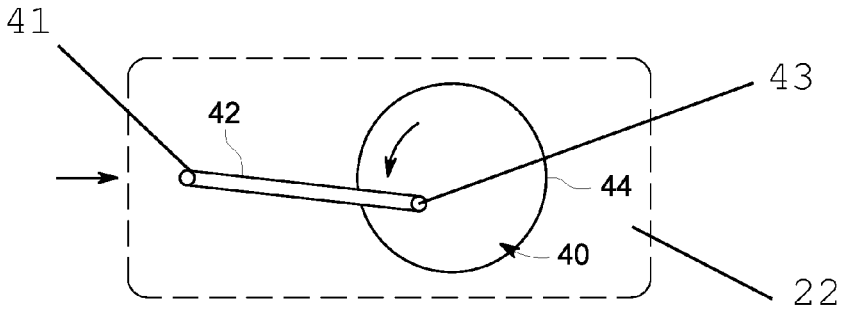
FIG. 2B is a see-through view of seat assembly 20 to show actuating member 40 still in its displaced position as link member 42 rotates around actuating disk 44.
Figure 2C:
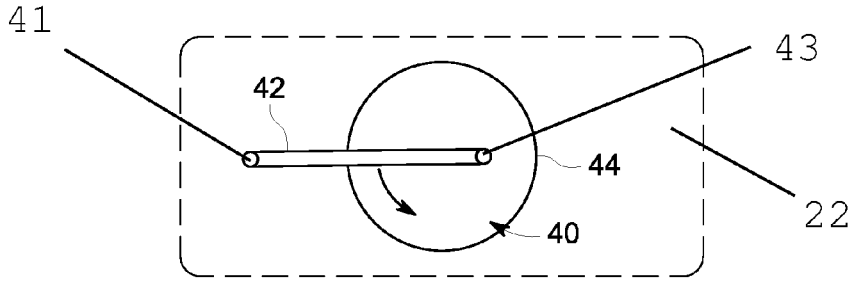
FIG. 2C is a see-through view of seat assembly 20 to show actuating member 40 in its retracted or original position and seat assembly 20 has been laterally shifted again to its starting point.
Figure 3:
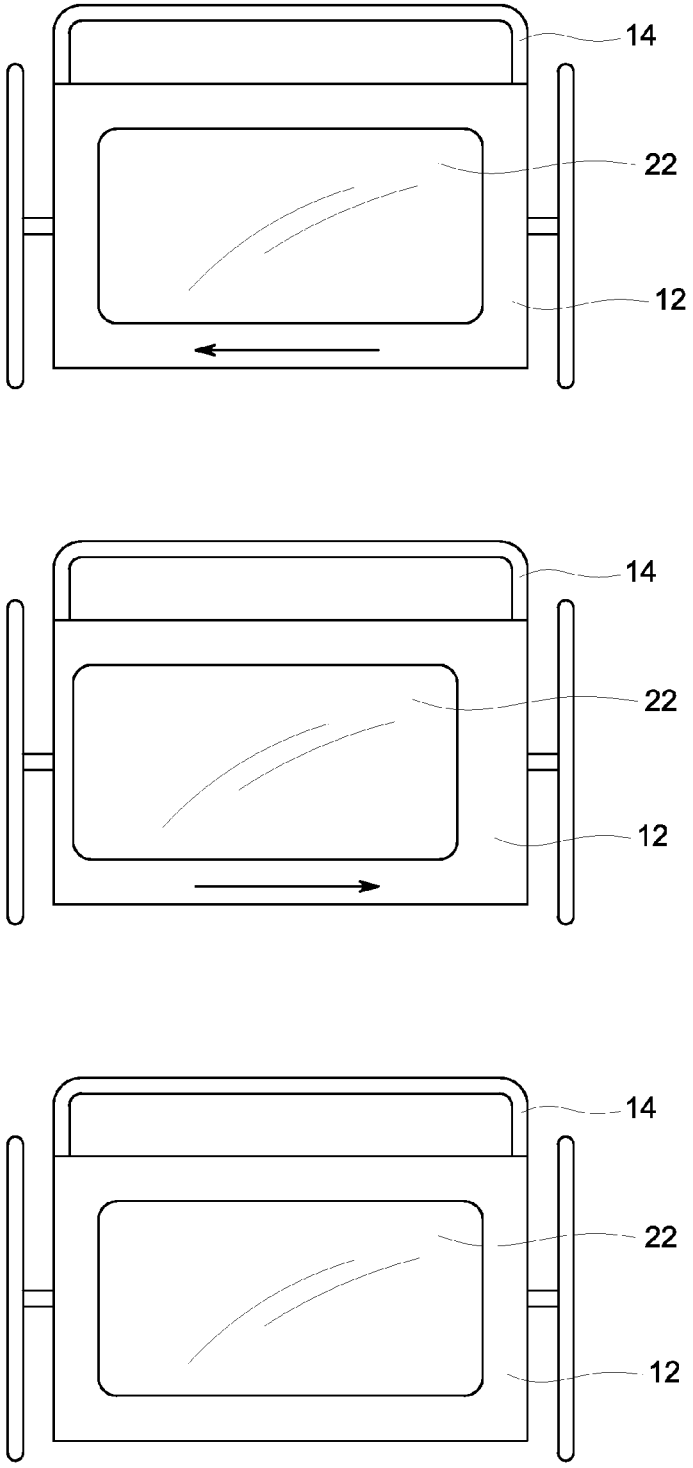
FIG. 3 is a representation of an operating diagram of seat assembly 20 showing how it displaces while mounted to a wheelchair.

Second distal end 43 of actuating rod 42 is mounted to actuating disk 44 that rotates in a clockwise or counterclockwise manner to urge actuating rod 42 to move seat member 22 laterally to the right or left, as shown in FIGS. 2-3. This movement shifts seat member 22 laterally a given direction under a user to prevent pressure ulcers from forming on the user's body.

Figure 4:
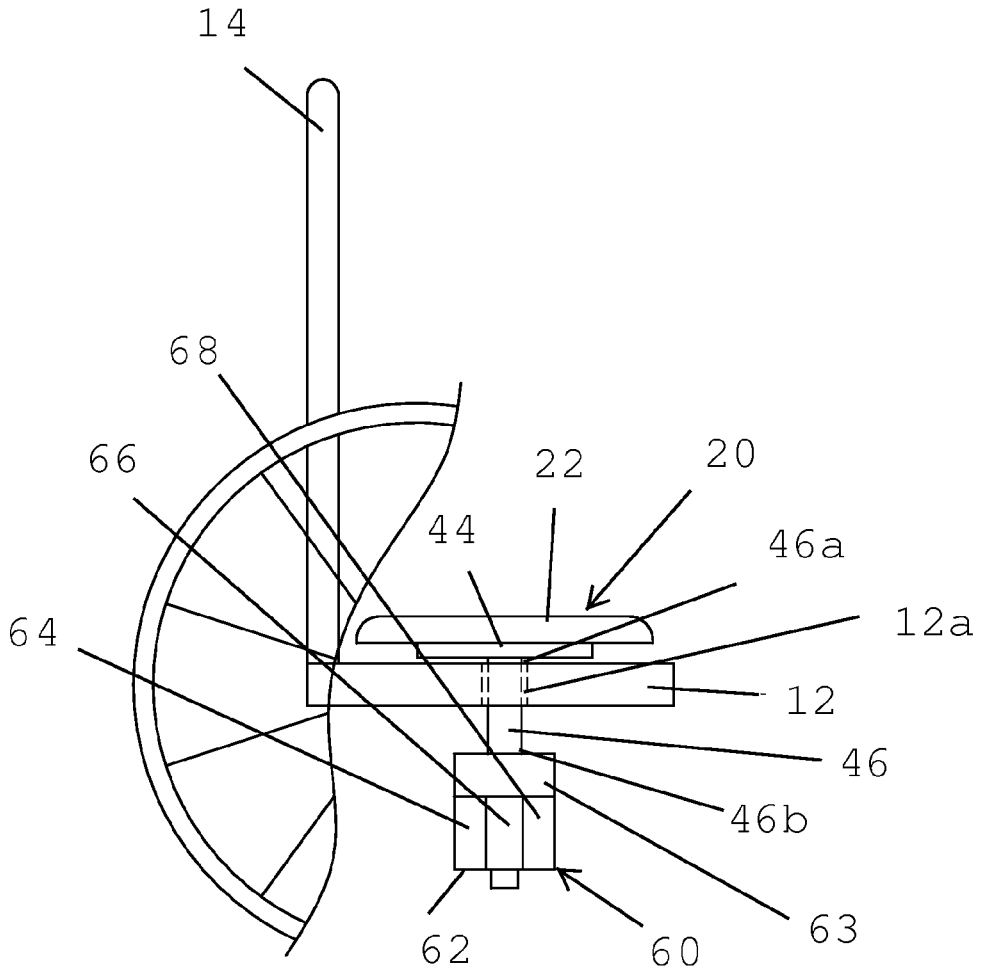
FIG. 4 is a side partial view of a wheelchair having the present invention with all of its components mounted thereon.

As seen in FIGS. 1 and 4, actuating disk 44 is perpendicularly mounted to a first shaft end 46*a* of rotating longitudinal shaft 46, which is mounted at its second opposite shaft end 46*b* to control unit assembly 60. Rotating longitudinal shaft 46 passes through seat opening 12*a* as it connects actuating disk 44 to control unit assembly 60.

Control unit assembly 60 includes housing 62 that houses electric motor 63, motor speed reducer 64, rechargeable battery 66, and motor regulator 68. Motor 63 causes shaft 46 to rotate thereby rotating actuating disk 44 and moving actuating rod 42 to shift the positioning of seat 22. Reducer 64 reduces the speed at which actuating disk 44 rotates to provide a slower lateral movement to seat member 22. Motor speed regulator 68 allows a user to control the frequency and speed of the rotational movement of actuating disk 44. In addition, motor speed regulator 68 controls the amount of clockwise or counterclockwise motion of actuating disk 44, thereby controlling the displacement distance of bilateral shifting by seat member 22.

In an alternate embodiment, actuating disk 44 and/or actuating rod 42 can be of varying dimensions depending on the amount of displacement desired of seat member 22. The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wheelchair seat assembly comprising:

a seat member having a bottom surface further including an actuating rod having a first end and second end, said first end mounted to said bottom surface at a predetermined position to allow for effective bilateral movement of said seat member, an actuating disk having a top and bottom surface, said second end of said actuating rod mounted to a predetermined point on said actuating disk's top surface that cooperates with the effective bilateral movement of said seat member, an opening extending longitudinally through said seat member, a shaft having a first and second end, said shaft's first end mounted to said actuating disk's bottom surface, said shaft extending perpendicularly therefrom, through said opening, and having said second end perpendicularly mounted to a control unit assembly, said control unit assembly including a housing that houses a motor and a battery, said motor rotates said shaft to cause said actuating disk to rotate and urge said actuating rod in a predetermined lateral direction, thereby displacing said seat member a predetermined distance.

2. The wheelchair seat assembly subject of claim 1 wherein said control unit assembly includes a motor speed reducer that reduces the speed of said shaft's rotation.

3. The wheelchair seat assembly subject of claim 1 wherein said control unit assembly includes a motor regulator that regulates the frequency and speed of said shaft's rotation, thereby regulating the frequency and speed of said seat member's displacement.

4. The wheelchair seat assembly subject of claim 1 wherein said battery is rechargeable.

5. The wheelchair seat assembly subject of claim 1 wherein said actuating disk is of a larger dimension to displace said seat member a greater amount.

6. The wheelchair seat assembly subject of claim 1 wherein said actuating rod is of a larger dimension to displace said seat member a greater amount.

* * * * *